3/5/85 XR 4,502,273

United States Patent [19]

Miyamoto et al.

[11] Patent Number: 4,502,273

[45] Date of Patent: Mar. 5, 1985

[54] SPINNING ROTOR IN AN OPEN-END SPINNING FRAME

[75] Inventors: Noriaki Miyamoto, Toyota; Norio Inoue, Takahama, both of Japan

[73] Assignee: Kabushiki Kaisha Toyoda Jidoshokki Seisakusho, Kariya, Japan

[21] Appl. No.: 476,256

[22] Filed: Mar. 17, 1983

[30] Foreign Application Priority Data

Mar. 20, 1982 [JP] Japan ..... 57-44804

[51] Int. Cl.[3] ..... D01H 7/882; B23K 27/00

[52] U.S. Cl. ..... 57/414; 57/416; 219/121 L

[58] Field of Search ..... 57/400, 404, 414, 416; 219/121 L, 121 LM

[56] References Cited

U.S. PATENT DOCUMENTS

| | | | |
|---|---|---|---|
| 4,167,846 | 9/1979 | Shaw et al. | 57/414 |
| 4,193,253 | 3/1980 | Herber et al. | 57/414 |
| 4,304,978 | 12/1981 | Saunders | 219/121 LM X |
| 4,315,130 | 2/1982 | Iwagaki et al. | 219/121 L X |
| 4,370,540 | 1/1983 | Davis et al. | 219/121 L X |

OTHER PUBLICATIONS

Roger Allen, IEEE Spectrum (Publication), "Lasers in the Factory", 1979.

*Primary Examiner*—Donald Watkins

*Attorney, Agent, or Firm*—Brooks, Haidt, Haffner & Delahunty

[57] ABSTRACT

An improved spinning rotor for an open-end spinning frame is disclosed herein, according to which the rotor is made of steel, and selected portions of its interior peripheral surfaces, including the fiber-collecting groove thereof, which is formed along the maximum-diameter region within the spinning chamber, are heat-treated by a focused laser beam or focused electron beam to harden the same. Due to the nature of laser beams, only those areas which require surface hardening are heat-treated without heating the entire rotor body, so that no strain or distortion is developed in the rotor during the heat treatment process. As a result, the rotor is heat-treated to provide excellent wear-resisting properties and exceptional stability in operation at an extremely high speed for an extended period of service.

16 Claims, 4 Drawing Figures

SPINNING ROTOR IN AN OPEN-END SPINNING FRAME

FIELD OF THE INVENTION

The present invention relates generally to a spinning rotor in an open-end spinning frame. More specifically, it relates to an improved spinning rotor which is made of steel and has part of its interior surfaces hardened.

BACKGROUND OF THE INVENTION

In rotor spinning of yarn using an open-end spinner, fibers which have first been separated into individual fibers by a combing or fiber opening mechanism and then drawn under the influence of a flowing air stream into the spinning chamber of the rotor, are collected within the peripherally extending fiber-collecting groove, formed along the maximum diameter region within the spinning chamber. The fibers thus deposited in the fiber-collecting groove are withdrawn continuously therefrom in the form of a twisted and elongated strand of yarn through the yarn guide tube. The rotor, which rotates at an extremely high speed, is conventionally made of an aluminium alloy having a relatively low specific gravity and moderate strength with a view to reducing power consumption in driving the rotor and to avoid damage or deformation of the rotor by the high centrifugal forces developed by the rotor as it is being driven at high speed.

However, the demand for improvement in open-end spinning productivity has boosted the rotor speed up to more than 30,000 rpm, with the result that the rotor of aluminium alloy used for a certain period of service has shown deformation or wear at the inner peripheral surface or fiber contacting surface along which the fibers are forced to slide during their introduction into the rotor under the influence of the centrifugal force, as well as at the fiber collecting groove formed at the maximum diameter in the spinning chamber of the rotor. Such wear is particularly rapid at the latter fiber collecting groove where the fibers are collected and then formed into a strand of yarn while being twisted. Thus, said fiber collecting groove is placed under continuous abrasive action by the fibers. Since the configuration of the fiber collecting groove plays a critical part in the formation of a yarn, any wear or deformation thereat is harmful and will naturally affect the process of yarn formation. As a result, the quality of the yarn being spun will be degraded.

There are several factors which are responsible for the above-stated wear of the rotor. One is the magnitude of impacting shocks which take place when the individual fibers flowing out of the fiber feeding tube impinge against the rotor's inner fiber contacting surface which is moving at a much greater peripheral speed than the fibers. Another is the abrasive action produced when such fibers are forced to slide in contact with the inner peripheral surface toward the fiber collecting groove under the influence of the centrifugal force developed by the rotor running at an extremely high speed. In addition to such impinging fibers, foreign matter or impurities contained in the fibers, such as grit, fragments of leaves or seeds, etc. promote rapid wear at the interior surfaces of the rotor. Furthermore, the fiber-collecting groove, where the fibers are twisted with each other to form a yarn under the influence of great centrifugal force and are subsequently withdrawn therefrom inwardly, against that centrifugal force, is subjected to an extremely high degree of continuous abrasive, frictional contact with the twisting yarn. Consequently, inordinate wear with consequent deformation of the groove configuration will take place after a period of spinning operation, thus deteriorating the quality of yarn which is spun out.

Many attempts were made to provide an improved aluminium rotor which could successfully withstand both high-speed operation and the above-mentioned abrasive forces for a sufficiently extended period of service, including surface treatment processes such as by coating, electro-plating or anodizing. Of these, anodizing of the rotor proved to be the best, because it exhibited the desired wear-resisting performance, thus retaining the originally machined flat surfaces of the fiber collecting groove and of the fiber contacting surface and causing the least change in the internal diameters of the rotor.

In recent years, under the demand for further increases of rotor speed up to from about 60,000 to 100,000 rpm for achieving still higher producitivity in spinning mills, the conventional rotor of aluminium alloy having anodized surfaces has been found inadequate for meeting the exacting requirements of rotor spinning at such super high speeds.

An approach to solving the problems associated with such conventional rotors has been proposed by U.S. Pat. No. 4,167,846, according to which the rotor body is made of steel and its interior surfaces are hardened by such treatment as induction heating, carburizing or nitriding. The surfaces obtained on the rotor by the method according to this prior art can offer adequate wear-resistance even at rotor speeds as high as 60,000 to 80,000 rpm. However, a rotor which has undergone such case hardening treatment has a disadvantage in that the heating necessary for the treatment is applied not only to the area which calls for hardening, but also to other portions in the rotor. As a result of such heating, strain or distortion will inevitably be produced within the rotor, causing harmful vibrations during the rotation thereof at a very high speed, thereby inviting degradation of yarn quality and rendering the rotor incapable of providing stable operation over a prolonged period of useful service.

SUMMARY OF THE INVENTION

With such background of the state of the art in mind, it is an object of this invention to provide an improved rotor for an open-end spinning frame, which avoids the above-mentioned disadvantages and drawbacks and whose interior surfaces exhibit adequate wear-resistance against the inflow of ordinary fibers, as well as of foreign materials such as grit or fragments of leaves or seeds.

This object of the invention is accomplished by fabricating the rotor of steel and applying a hardening treatment only to those surfaces of the rotor which require such hardening, thus avoiding strain or distortion within the rotor body itself.

The above and other objects, features and advantages of the present invention will become apparent to those skilled in the art from the following detailed description of preferred embodiments of the invention, taken in conjunction with the accompanying drawings, wherein:

DETAILED DESCRIPTION OF PREFERRED EMBODIMENTS

Figure 1:
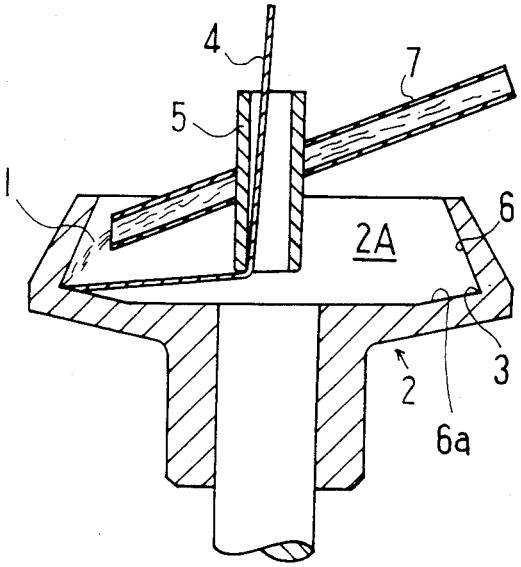
FIG. 1 is a sectional view of a spinning rotor and its relevant parts in an open-end spinning unit, showing in a simplified way how fibers are fed into the rotor and a spun yarn is withdrawn therefrom.

Referring to FIG. 1 which shows the general configuration of a rotor 2 for an open-end spinning frame (not shown), fibers 1 which have already been opened-up or separated into individual fibers by a combing roller (not shown) are transferred through a fiber feeding tube 7 into the circular spinning chamber 2A which is defined by the interior surfaces of the rotor. The fibers 1 thus introduced into the spinning rotor 2 are moved by centrifugal force along the downwardly and outwardly inclined interior peripheral surface or fiber contacting sidewall surface 6 to a peripherally extending fiber collecting groove 3 formed by the conjuncture between the sidewall surface 6 and the chamber bottom surface 6*a* at the maximum-diameter region within the spinning chamber, where the deposited fibers are formed into a continuous strand of twisted spun yarn 4. The spun yarn 4 is continuously withdrawn through a yarn guide tube 5, in well-known manner.

As previously mentioned, the fiber contacting sidewall surface 6 and fiber collecting groove 3 of the spinning chamber 2A are subjected to abrasion due to the frictional contact of fibers 1 and impurities, if any, such as grit or the like contained therein. Therefore, the rotor requires sufficient hardness to resist such wear, thereby to promote a longer period of useful life of the rotor with greater stability of operation. According to the embodiments of the invention, such requirements are achieved by providing a rotor which is made of steel and which has only portions of its interior surfaces hardened by heat-treatment using an emitted beam of high energy radiation, preferably a laser beam or a beam of electrons.

Because a rotor according to the present invention differs from a conventional rotor only with reference to the manner of surface hardening and not with reference to its overall shape or configuration, the same reference numerals as used in FIG. 1 are used to designate the rotor and rotor parts in the embodiments of the invention to be described.

Steel, if its carbon content is less than 0.5 percent, can be cut with the same degree of machinability as the aluminium alloy which has been selected heretofore as the material for the rotor body. This means that conventional machine tools for cutting aluminium alloy may be utilized to generate the smooth cut surfaces on a rotor made of such steel as those obtained on the aluminium alloy.

Figure 2:
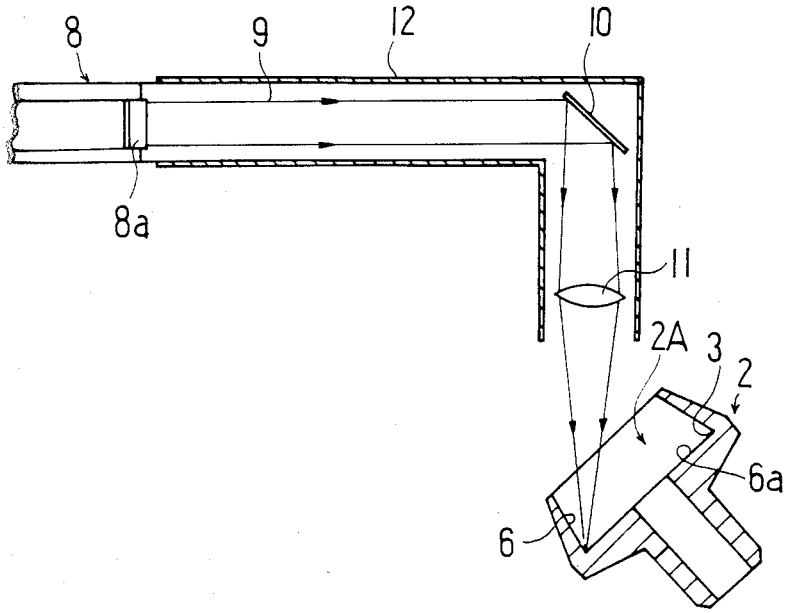
FIG. 2 is a schematic sectional view showing an arrangement in which a rotor in accordance with one embodiment of the invention is being treated by a laser beam to produce localized surface hardening in the rotor.

Reference is now made to FIG. 2 which illustrates one method by which the desired local areas of a rotor may be hardened in accordance with the present invention. A rotor 2 made of steel is rotatably supported in any convenient way and a beam of radiant energy, preferably a laser beam 9 emitted from a laser beam generator 8, is reflected by an angular mirror 10 and spot-focused by a lens 11 on a point or spot within the fiber collecting groove 3 of the rotor 2. In the laser apparatus shown in FIG. 2, the passage for the laser beam 9 is enclosed for protection thereof by an enclosure tube 12 so that the laser beam 9 which is transmitted through a one-way mirror 8*a*, may not be subjected to interferences on its way. In the illustrated arrangement, the laser beam 9 is emitted with a beam diameter of 22 mm through the one-way mirror 8*a*, which has a reflectivity of 95 percent, and is reflected by the angular mirror 10 to change its direction, whereupon it passes through the lens 11 with a beam diameter of 30 mm. The beam 9 is focused by the lens 11 and is directed and applied to the location within the fiber collecting groove 3 along which the surface hardening treatment is desired. In the arrangement of FIG. 2, the laser beam 9 is directed along the entire periphery of the fiber collecting groove 3 merely by turning the rotor 2 on its axis of rotation, the mirror 10 and the lens 11 being held in stationary positions. The rate of turning depends upon how rapidly the rotor chamber surface areas achieve the required hardening temperature for the steel rotor material selected after which the surface is immediately cooled by removal of the beam.

Because of its extremely high coherence, the laser beam 9 can be controlled very precisely and can be directed against the target point or spot through adjustment of the mirror 10 and the lens 11. Accordingly, it can be easily directed and focused upon locations of difficult accessibility located deep within the rotor 2. When it is focused properly by the lens 11, the light energy from the laser beam 9 is concentrated in an extremely limited area or spot, thereby increasing its energy per unit area. The light energy is converted into heat energy as it strikes the point of application on the rotor. Therefore, only that area of the rotor which is subjected to the laser beam 9 is heated, and the desired degree of temperature can be reached in an extremely short time. When emission of the beam 9 is stopped, the heated area cools by itself, thus completing the localized surface hardening treatment. As will be apparent from the foregoing, unlike conventional methods of surface hardening, the self-cooling feature of the invention eliminates the need for forced cooling of the metal by a coolant such as water or oil.

This surface hardening by use of a laser beam 9 does not produce any strain or distortion in the rotor 2 because the laser beam heats only those areas which are subjected to the influence of the beam, and the heat build-up within the rotor itself is quite negligible. A rotor 2 which is heat-treated in this way and which therefore has virtually no strain or distortion therein, not only has its interior surfaces hardened sufficiently to resist wear or deformation, but also has exceptionally high stability during the spinning operation at speeds of more than 80,000 rpm over a protracted period of time. Thus, the above-mentioned problems resulting in poor quality of yarn may be eliminated successfully.

The Table below reveals the results obtained from experiments on surface hardening of rotors using a carbon dioxide ($CO_2$) laser beam having an emitted wavelength of 10.6 μmm and 1 kW of output power, and wherein the laser beam is focused to a spot diameter of one-half (0.5 mm) millimeter (lens focal distance: 250 mm) and the rotor is rotated at a speed of four (4 rpm) revolutions per minute during the surface hardening process.

| Rotor Material (JIS) | Before Treatment Surface Hardness (Vickers Number) | After Treatment | |
|---|---|---|---|
| | | Depth of Hardening (mm) | Surface Hardness (Vickers Number) |
| S45C | 180 | 0.3 | 850 |
| S25C | 140 | 0.3 | 600 |
| SUS440C | 280 | 0.3 | 870 |

For reference, the above materials designated as S45C, S25C and SUS440C according to JIS (Japanese Industrial Standard) correspond substantially to SAE (Society of Automotive Engineers) 1045, 1024 and 51440C, respectively.

Figure 3:
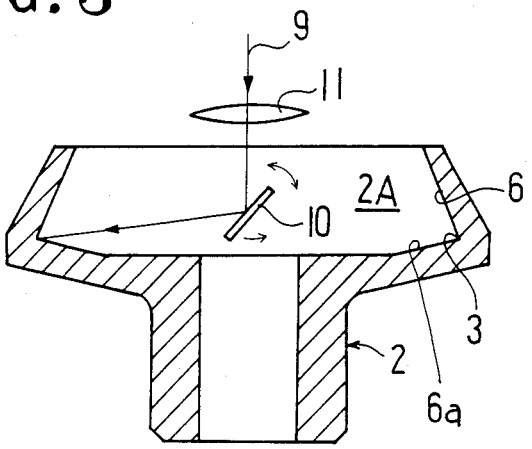
FIG. 3 is a schematic sectional view, showing another arrangement for hardening selected surface areas of a rotor using a laser beam.
Figure 4:
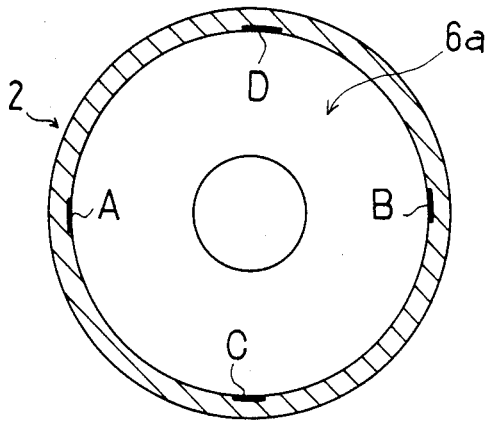
FIG. 4 is a transverse sectional view of a rotor taken substantially along the fiber collecting groove thereof, and illustrating a manner of applying a laser beam treatment to the rotor.

Though heat treatment for the periphery along the fiber collecting groove 3 is performed in FIG. 2 by rotating the rotor 2 on its rotational axis for successively changing the position of laser beam 9 application, the same periphery may be heat-treated by rotating the mirror 10 while the rotor 2 is set in a fixed position as shown in FIG. 3. If desired, the mirror 10 in FIG. 3 may be made tiltable so as to direct the laser beam 9 across the periphery, or both the rotor 2 and the mirror 10 may be tiltable and/or movable. Furthermore, instead of changing the location of application of the laser beam 9 in a continuous manner along the rotor periphery, the laser beam 9 may be applied in a successive spot-to-spot manner along the periphery. As a further alternative, the laser beam 9 may be directed first to an arbitrarily selected spot or area "A" (see FIG. 4) and subsequently to the spot or area "B" which is farthest away from the spot "A" along the groove 3, and then to the spots "C" and "D", and so on in intermittent sequence, so that each shot of the laser beam 9 is applied to the area which is farthest from that to which the immediately preceding shot was directed.

Though the above-mentioned experiment on rotor surface hardening was made using a $CO_2$ laser, other types of lasers, such as a yttrium aluminum garnet (YAG) laser or ruby laser, may be employed. Other appropriate forms of radiant energy, such as an electron beam might also be used in place of the laser beam 9 in the same way and for the same purpose of locally heating and thereby surface hardening the rotor 2.

Thus, a spinning rotor according to the present invention is made of steel and has only a portion of its interior surfaces, including the fiber collecting groove formed at the region of maximum diameter in the rotor, heat-treated and hardened by a laser beam or an electron beam. The thus treated rotor is capable of providing excellent wear-resistance which can endure the abrasive action of incoming fibers and any foreign matter contained therein such as grit, while maintaining a high degree of stability in operation at extremely high speeds over a prolonged period of useful service.

What I claim is:

1. A spinning rotor made of steel material for an open-end spinning frame comprising a rotor body having interior surfaces defining a circular spinning chamber of said rotor including a peripherally extending fiber-collecting groove formed by said surfaces along the region of maximum diameter within said spinning chamber, said steel material containing less than 0.5 percent carbon, and only selected portions of said interior surfaces, including at least those portions thereof which form said fiber-collecting groove, being surface-hardened by heat treatment using a beam of high energy radiation applied substantially momentarily to said selected surface portions.

2. A spinning rotor according to claim 1 wherein said surface-hardening extends to a depth of substantially 0.3 millimeters (0.3 mm), and the hardness number thereof being within the range of from substantially 600 to substantially 870 on the Vickers hardness scale.

3. A spinning rotor as set forth in claim 1, wherein said rotor body interior surfaces include an interior sidewall surface, and said surface-hardened portions include at least a portion of said sidewall surface.

4. A spinning rotor as set forth in claim 1, wherein said interior surface portions which form said fiber-collecting groove are surface-hardened by heat treatment at a plurality of spots along the periphery thereof.

5. The method of heat-treating and thereby hardening selected interior surface portions of the circular spinning chamber of an open-end spinning rotor made of steel material, including at least those portions which define the fiber-collecting groove of said chamber, comprising focusing and applying a beam of high energy radiation only upon said selected interior surface portions to heat the same sequentially by continuously focusing said beam at a beam focusing point on a surface portion within said selected interior surface portions and providing relative rotational movement between said rotor and said beam whereby said beam is focused upon all of said surface portions sequentially and for a momentary period of time sufficient to heat the same to a preselected heat-treating temperature, and discontinuing said applying of the beam as said preselected heat-treating temperature is reached to permit cooling and hardening of said selected interior surface portions.

6. The method of heat-treating and thereby hardening selected interior surface portions of the circular spinning chamber of an open-end spinning rotor made of steel material, including at least those portions which define the fiber-collecting groove of said chamber, comprising focusing and applying a beam of high energy radiation upon said selected interior surface portions to heat the same, said steel material containing less than 0.5 percent carbon, said beam of high energy radiation being a laser beam continuously focused at a beam focusing point, and providing rotational movement between said rotor and said beam focusing point to apply said beam to all of said selected interior surface portions, and discontinuing said applying of the beam as the desired heat-treating temperature is reached to permit cooling and hardening of said selected interior surface portions.

7. The method according to claim 6 wherein said laser beam is emitted having substantially one kilowatt (1 kW) of output power, said beam focusing point has a diameter of substantially one-half millimeter (0.5 mm), and said rotational movement is at a rate of substantially four revolutions per minute (4 rpm).

8. The method according to claim 7 wherein said laser beam is emitted having a wavelength of substantially 10.6 micromillimeters (10.6 μmm).

9. The method off heat-treating and thereby hardening selected interior surface portions of the circular spinning chamber of an open-end spinning rotor made of steel material, including at least those portions which define the fiber-collecting groove of said chamber, comprising focusing and applying a beam of high energy radiation at a point of said fiber-collecting groove of said chamber to heat the same, intermittently and sequentially moving and focusing said beam between and upon other points along said fiber-collecting groove, widely spaced points therealong, including opposite points, being focused upon sequentially, and discontinuing said applying of the beam as the desired heat-treating temperature is reached to permit cooling and hardening of said selected interior surface portions.

10. The method according to claim 5 wherein said beam of high energy radiation is a laser beam.

11. The method according to claim 10 wherein said laser beam is emitted from a carbon dioxide ($CO_2$) laser.

12. The method according to claim 10 wherein said laser beam is emitted from a yttrium aluminium garnet (YAG) laser.

13. The method according to claim 10 wherein said laser beam is emitted from a ruby laser.

14. The method of heat-treating and thereby hardening selected interior surface portions of the circular spinning chamber of an open-end spinning rotor made of steel material, including at least those portions which define the fiber-collecting groove of said chamber, comprising focusing and applying a laser beam of high energy radiation upon said selected interior surface portions to heat the same, said laser beam being intermittently and sequentially focused upon substantially opposite points along the length of said fiber-collecting groove of said chamber, and discontinuing said applying of the beam as the desired heat-treating temperature is reached to permit cooling and hardening of said selected interior surface portions.

15. The method according to claim 5 wherein said beam of high energy radiation is an electron beam.

16. The method of heat-treating and thereby hardening selected interior surface portions of the circular spinning chamber of an open-end spinning rotor made of steel material, including at least those portions which define the fiber-collecting groove of said chamber, comprising focusing and applying an electron beam of high energy radiation upon said selected interior surface portions to heat the same, said electron beam being intermittently and sequentially focused upon substantially opposite points along the length of said fiber-collecting groove of said chamber, and discontinuing said applying of the beam as the desired heat-treating temperature is reached to permit cooling and hardening of said selected interior surface portions.

* * * * *